US005874878A

United States Patent [19]

Jackson, Jr.

[11] Patent Number: 5,874,878

[45] Date of Patent: Feb. 23, 1999

[54] MAGNETIC PROXIMITY SWITCH SYSTEM WITH SLIDE-BY ANTI-DEFEAT MACHANISM

[76] Inventor: John T. Jackson, Jr., 316 California Ave., Suite 745, Reno, Nev. 89509

[21] Appl. No.: 844,969

[22] Filed: Apr. 28, 1997

Related U.S. Application Data

[60] Provisional application No. 60/016,309, May 8, 1996, 60/028,491, Oct. 15, 1996 and 60/030,988, Nov. 15, 1996.

[51] Int. Cl.[6] ..... H01H 9/00

[52] U.S. Cl. ..... 335/205; 335/206; 340/547

[58] Field of Search ..... 325/205.2, 547, 325/542, 545

[56] References Cited

U.S. PATENT DOCUMENTS

| | | | |
|---|---|---|---|
| 2,912,540 | 11/1959 | Sawicki | 200/87 |
| 3,626,340 | 12/1971 | Mason et al. | 335/205 |
| 3,668,579 | 6/1972 | Harman | 335/207 |
| 4,210,888 | 7/1980 | Holce | 335/207 |
| 4,210,889 | 7/1980 | Holce | 335/207 |
| 4,211,991 | 7/1980 | Lombard et al. | 335/207 |
| 4,213,110 | 7/1980 | Holce | 335/207 |
| 4,271,338 | 6/1981 | Rakocy | 200/61.71 |
| 4,339,747 | 7/1982 | Maybee | 340/547 |
| 4,544,903 | 10/1985 | Grant | 335/205 |
| 4,798,922 | 1/1989 | Brill | 335/206 |
| 4,945,340 | 7/1990 | Brill | 340/547 |
| 5,233,323 | 8/1993 | Burkett et al. | 335/207 |
| 5,416,456 | 5/1995 | Light | 335/205 |
| 5,668,533 | 9/1997 | Jackson, Jr. et al. | 340/547 |

OTHER PUBLICATIONS

Sentrol® Product Information Bulletin, "2700 Series High Security Balanced Magnetic Contacts" (4 pages), 1981.

Securiton Maximum Security Switch Data Sheet (2 pages), Apr. 1996.

*Primary Examiner*—Lincoln Donovan

[57] ABSTRACT

A non-magnetic plate, or spacer block, of is attached to the side of the switching assembly of a high security switch system. Alternatively, the actuator assembly may have an extended housing. As a result, a second actuator assembly may not be substituted for the first actuator assembly by placing the second actuator assembly on the side of the first actuator assembly and slid under the security switch assembly as the first actuator assembly is moved away for the purpose of defeating the security switch.

19 Claims, 3 Drawing Sheets

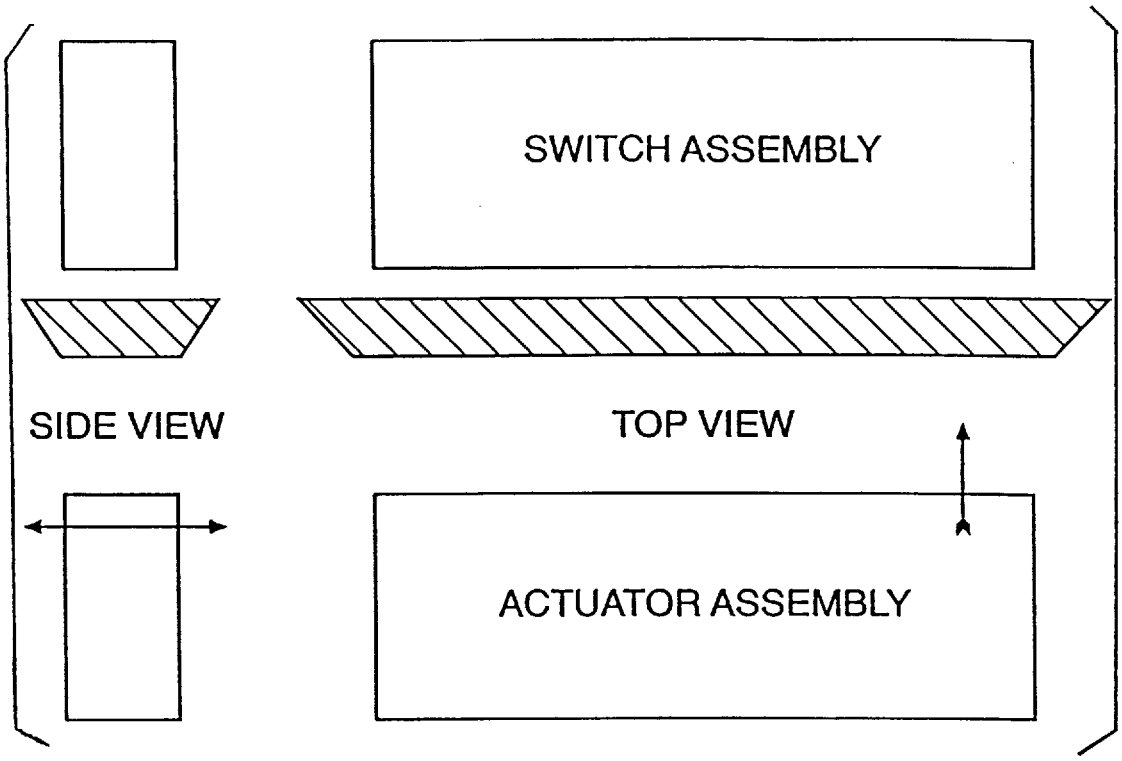
FIG. 1A
PRIOR ART
FIG. 1B
PRIOR ART
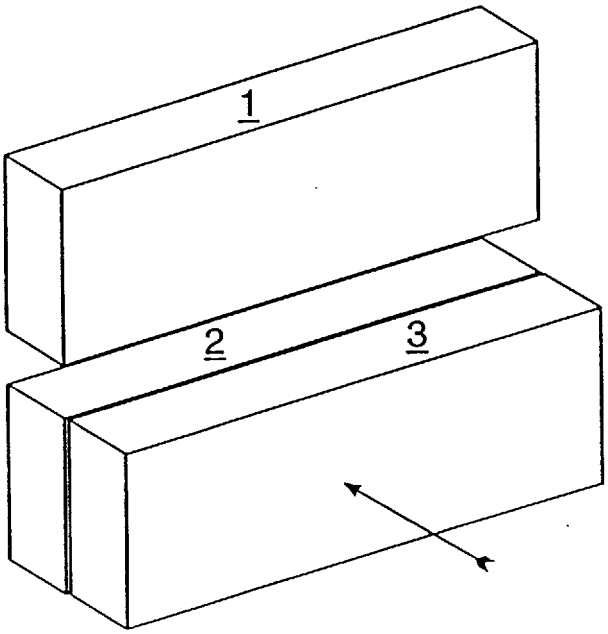
FIG. 2

MAGNETIC PROXIMITY SWITCH SYSTEM WITH SLIDE-BY ANTI-DEFEAT MACHANISM

U.S. Provisional Patent Application No. 60/016,309 (Jackson) filed May 8, 1996, U.S. Provisional Patent Application No. 60/028,491 (Jackson) filed Oct. 15, 1996, and U.S. Provisional Patent Application 60/030,988 (Jackson) filed Nov. 15, 1996, are hereby incorporated by reference.

BACKGROUND OF THE INVENTION

1. Field of the Invention

The present invention relates to a magnetic proximity switch system.

2. Discussion of the Related Art

The actuation range of conventional magnetically actuated proximity security switches, for example, balanced type magnetically actuated reed switches, must be wide enough so that false alarms are not generated by mechanical vibrations or small displacements of the door or any other moveable object to which the actuator assembly is fixed. The conventional actuator assembly housing has the same thickness as the switch assembly housing. Because the actuation range of the switch assembly housing extends beyond the actuator assembly housing, conventional switches are vulnerable to defeat by placing a second actuator assembly on the side of the first actuator and sliding it under the security switch assembly as the first actuator assembly is moved away. The second actuator assembly may be a duplicate of the first actuator assembly, a mechanically modified version of the first actuator assembly, or a specially designed lock picking actuator assembly.

SUMMARY OF THE INVENTION

Accordingly, the present invention is directed to a magnetic proximity switch system that substantially obviates one or more of the problems due to limitations and disadvantages of the related art.

An object of the present invention is to provide a reliable and economical magnetic proximity switch system.

Another object of the present invention is to provide a magnetical proximity switch system that cannot be defeated by the slide-by technique.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the magnetic proximity switch system comprises a switch assembly having at least one magnetically actuated proximity switch which is actuated by a magnetic field; an actuator assembly, movable with respect to the switch assembly, for providing the magnetic field to actuate the switch assembly when located in an actuation range defind about the switch assembly; and a spacer block disposed on a side of the actuator assembly to prevent insertions into the actuation range as the actuator is moved away from the switch assembly.

In another aspect, the magnetic proximity switch system comprises a switch assembly having at least one magnetically actuated proximity switch which is actuated by a magnetic field; and an actuator assembly, movable with respect to the switch assembly, for providing the magnetic field to actuate the switch assembly when located in an actuation range defined about the switch assembly, the actuator having a housing extended to prevent insertions into the actuation range as the actuator is moved away from the switch assembly.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 1A and 1B are a top view and a side view of a conventional high security switch showing a switch assembly, an actuator assembly, and the actuation range of the switch assembly;

FIG. 2 is a perspective view of a conventional high security switch showing a switch assembly and a second actuator assembly placed on the side of a first actuator assembly for the purpose of "slide-by" defeat;

DESCRIPTION OF THE PREFERRED EMBODIMENTS

Reference will now be made in detail to the preferred embodiments of the present invention, examples of which are illustrated in the accompanying drawings.

In accordance with one embodiment of the present invention, a non-magnetic plate, or spacer block, is attached to the side of the actuator assembly housing of a high security switch system to physically occupy the space within the actuator range of the switching assembly. Alternatively, the actuator assembly housing may be extended to occupy the space within actuator range of the switching assembly. As a result, the security switch may not be defeated by substituting a second actuator assembly for the first actuator assembly by placing the second actuator assembly on the side of the first actuator assembly and sliding it under the security switch assembly as the first actuator assembly is moved away.

Some of the deficiencies of conventional high security switches will be described in connection with FIGS. 1A, 1B and 2. FIGS. 1A and 1B show a top view and a side view of a conventional high security switch comprised of a switch assembly 1 and an actuator assembly 2. When the actuator assembly 2 is proximate to the switch assembly 1, the magnetically-actuated switch is set to a first, actuated state. When the actuator assembly 2 is distal the switch assembly 1, the magnetically-actuated switch enters a second, non-actuated state. The actuation range, which is shown cross-hatched, refers to the region where when the face of the actuator assembly 2 may be positioned to actuate the switch assembly 1. The actuation range is set during production by adjustments of the biasing magnets. In a switch assembly having a particular sensitivity, the actuation range cannot be further controlled and is determined by measurement. In FIGS. 1A and 1B, the two-headed arrow indicates the range of motion of the actuator assembly when the actuator assembly 1 is inside the actuation range. The single-headed arrow shows the direction of motion for the actuator assembly 2 so that, if the face of the actuator assembly 2 is completely inside the cross-hatched actuation range, the switch assembly 1 enters and remains in the actuated state.

FIG. 2 shows a perspective view of a conventional high security switch showing a second actuator assembly 3 placed on the side of a first actuator assembly 2 for the purpose of "slide-by" defeat as a consequence of the allowable secure motion of the first actuator assembly 2 as established in FIGS. 1A and 1B. The arrow shows the direction of motion such that the second actuator assembly 3 takes the place of the first actuator assembly 2. If the first actuator assembly 2 is fixed to a door, the second actuator assembly 3 may be placed within the actuation range of the switch assembly 1 and fixed thereto by any suitable means. The door then can be completely opened with the switch assembly 1 remaining in the secure state, i.e., a breach of the physical security system.

Figure 3:
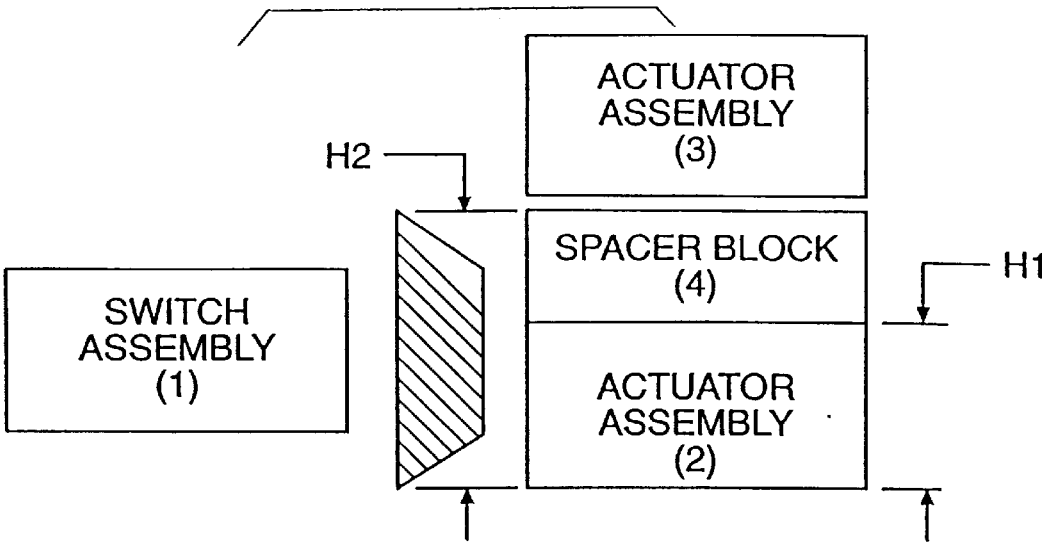
FIG. 3 is a two dimensional side view of a high security switch showing a switch assembly, a first actuator assembly, the actuation range of the switch assembly, a second actuator assembly, a spacer block of the present invention, and the justification for the minimum spacer block thickness.

FIG. 3 is a side view of a high security switch according to the present invention having a switch assembly 1, a first actuator assembly 2 adjacent the switch assembly, and a spacer block 4 on a side of the first actuator assembly 2. The spacer block 4 may be formed of a non-magnetic material, such as brass, aluminum, or plastic spacer block. The high security switch may be of the type disclosed in a U.S. patent application to John T. Jackson, Jr. entitled "Balanced Magnetic Proximity Switch Assembly, filed on even date herewith, and hereby incorporated by reference. Alternatively, the high security switch may be a magnetic proximity switch of the type disclosed in U.S. application Ser. No. 08/844,968 to John T. Jackson entitled "Magnetic Proximity Switch System", filed on Apr. 28, 1997, and hereby incorporated by reference. Of course, any magnetic security switch, such as a reed switch, may be used consistent with the present invention.

The actuation range of the switch assembly 1 is shown cross-hatched. The slide-by secure maximum range is designated by a distance H2. The distance H2 may be determined through measurements. The first actuator assembly 2 thickness is designated by H1. The difference between H2 and H1 is the minimum spacer block 4 thickness required to prevent the face of the second actuator assembly 3 from entering the cross-hatched secure actuation range and defeating the switch assembly 1. Of course, the spacer block 4 may be made larger than the distance H2–H1 to provide additional security.

Figure 4:
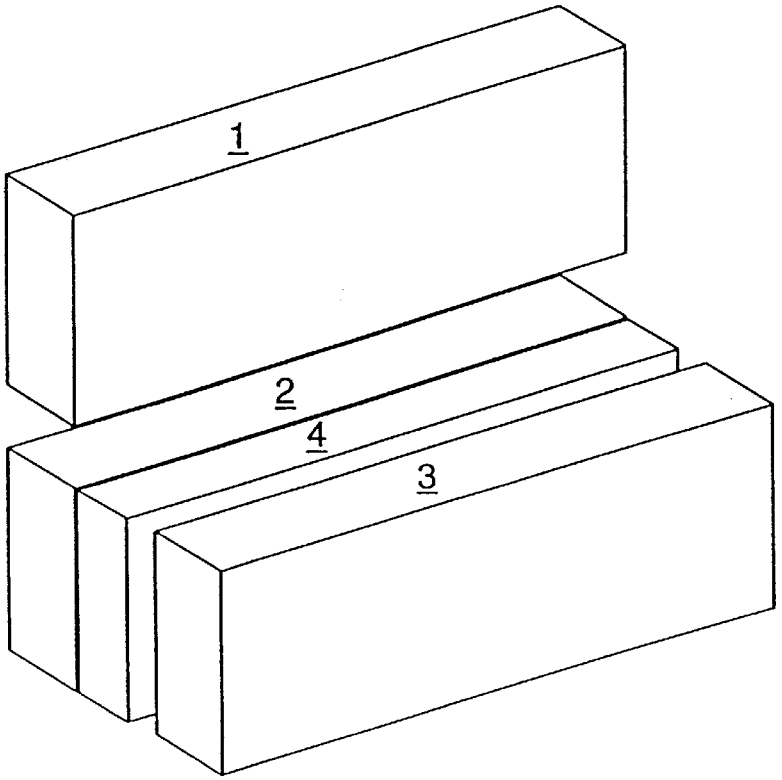
FIG. 4 is a perspective view of a high security switch showing a switch assembly, a first actuator assembly to which a spacer block is fixed, and a second actuator assembly outside the actuation range.

FIG. 4 is a perspective view of a high security switch showing one preferred embodiment of the present invention including a switch assembly 1, a first actuator assembly 2, and a spacer block 4 fixed to a side of the first actuator assembly 2. The spacer block 4 prevents a second actuator assembly 3 from entering the actuation range of the switch assembly 1, as shown. The spacer block 4 may substantially cover the face of the actuator assembly 2. In this way, modified actuator assemblies or special lock-picking actuator assemblies are prevented from gaining sufficient access to the actuation range to defeat the switch assembly. The spacer block 4 may be fastened to the actuator assembly 2 by any suitable means such as welding, brazing, adhesives, or mechanical fasteners. Of course, a second spacer block 4 may be fastened to the opposite side of the actuator assembly 2.

Figure 5:
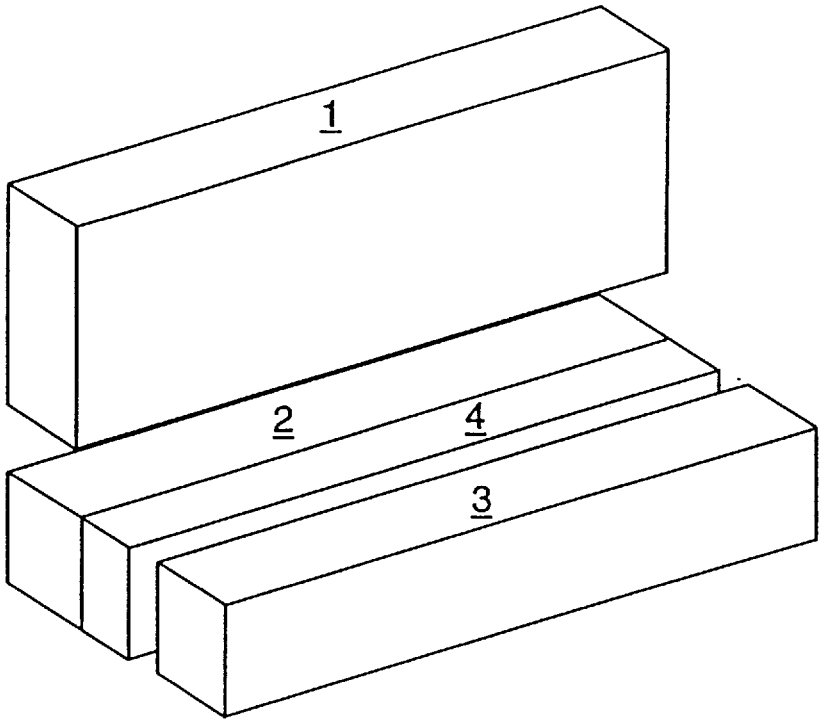
FIG. 5 is a perspective view of another high security switch showing a switch assembly, a first actuator assembly to which a spacer block is fixed, and a second actuator assembly outside the actuation range.

FIG. 5 is a perspective view of another preferred embodiment of a high security switch assembly according to the present invention. As shown, the high security switch assembly includes a switch assembly 1, a first actuator assembly 2, and a spacer block 4 substantially covering a face of the actuator assembly 2. The first actuator assembly 2 has a different geometry from the first actuator assembly 2 shown in FIG. 4. Similar to the embodiment shown in FIG. 4, the spacer block 4 prevents a second actuator assembly 3 from entering the actuation range of the switch assembly 1 as shown.

Figure 6:
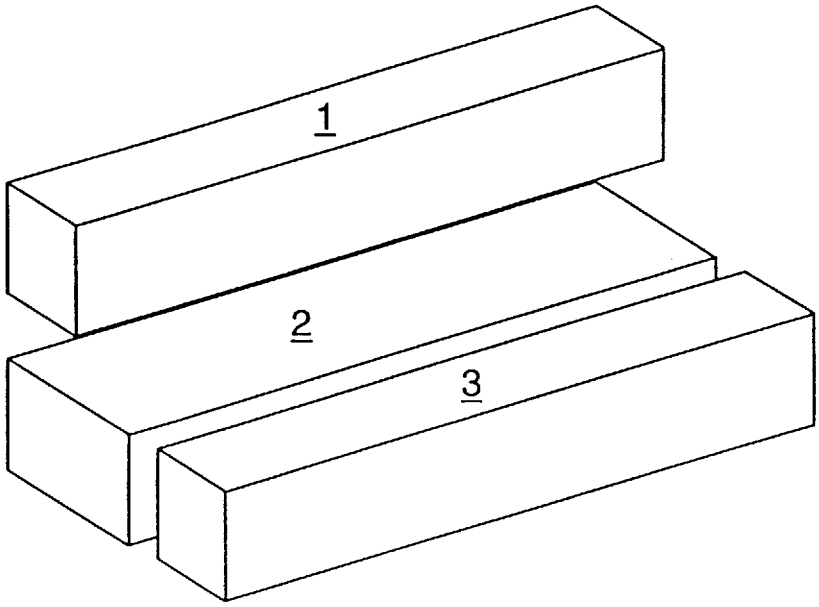
FIG. 6 is a perspective view of another high security switch showing a switch assembly, a first actuator assembly with an extended housing, and a second actuator assembly outside the actuation range.

FIG. 6 is a perspective view of a high security switch corresponding to another preferred embodiment of the present invention. The high security switch includes a switch assembly 1 and a first actuator assembly 2. The first actuator assembly 2 includes an extended housing for the same purpose as the spacer block. Specifically, the extended housing occupies the actuation range of the switch assembly 1. Accordingly, the extended housing prevents a second actuator assembly 3 from entering the actuation range of the switch assembly 1 as shown.

It will be apparent to those skilled in the art that various modifications and variations can be made in the slide-by anti-defeat mechanism of the present invention without departing from the spirit or scope of the invention. Thus, it is intended that the present invention cover the modifications and variations of this invention provided they come within the scope of the appended claims and their equivalents.

What is claimed is:

1. A magnetic proximity switch system, comprising:

a switch assembly actuated by a magnetic field;

an actuator assembly, movable with respect to the switch assembly, for providing the magnetic field to actuate the switch assembly when located in an actuation range defined about the switch assembly, the actuator assembly having a first surface disposed toward the direction of movement when the actuator assembly is moved away from the switch assembly and a second surface opposite the first surface; and a spacer block attached to the second surface of the actuator assembly to prevent insertions into the actuation range as the actuator assembly is moved away from the switch assembly but still located in the actuation range.

2. The magnetic proximity switch system according to claim 1, wherein a combined width of the spacer block and the actuator assembly is at least the width of the actuation range.

3. The magnetic proximity switch system according to claim 1, wherein the spacer block is fixed to the actuator assembly.

4. A magnetic proximity switch system, comprising:

a switch assembly actuated by a magnetic field;

an actuator assembly, movable with respect to the switch assembly, for providing the magnetic field to actuate the switch assembly when located in an actuation range defined about the switch assembly; and a spacer block fixed to the switch assembly to be disposed on a side the second surface of the actuator assembly to prevent insertions into the actuation range as the actuator assembly is moved away from the switch assembly but still located in the actuation range.

5. A magnetic proximity switch system, comprising:

a switch assembly having at least one magnetically actuated proximity switch which is actuated by a magnetic field; and an actuator assembly, movable with respect to the switch assembly, for providing the magnetic field to actuate the switch assembly when located in an actuation range defined about the switch assembly, the actuator assembly having a housing extended in a direction opposite to the direction of movement when the actuator assembly is moved away from the switch assembly to prevent insertions into the actuation range as the actuator assembly is moved away from the switch assembly but still in the actuation range.

6. The magnetic proximity switch system according to claim 5, wherein a width of the actuator assembly is at least the width of the actuation range.

7. The magnetic proximity switch system according to claim 1, wherein the magnetic proximity switch system monitors a security condition of an object, the first surface of the actuator assembly being mounted toward the object.

8. The magnetic proximity switch system according to claim 1, wherein the actuator assembly has a third surface that faces the switch assembly, each of the first and second surfaces being adjacent the third surface.

9. The magnetic proximity switch system according to claim 5, wherein the magnetic proximity switch system monitors a security condition of an object, the housing being extended in a direction away from the object.

10. The magnetic proximity switch system according to claim 5, wherein the housing has a first side that faces the switch assembly when the actuator assembly is in the actuation range and a second side that is adjacent the first side, the housing being extended in a direction of the second side.

11. A magnetic proximity switch system, comprising:

a switch assembly actuated by a magnetic field;

an actuator assembly for providing the magnetic field to actuate the switch assembly when located in an actuation range defined about the switch assembly, at least one of the actuator assembly and the switch assembly being moveable relative to the other so that the actuator can be located within the actuation range of the switch assembly and outside of the actuation range of the switch assembly, the actuator assembly having a first surface disposed toward the direction of relative movement of the actuator assembly and a second surface opposite the first surface; and a spacer block disposed on the second surface of the actuator assembly to prevent insertions into the actuation range as the at least one of the actuator assembly and the switch assembly is moved away from the other but the actuator assembly is still located in the actuation range of the switch assembly.

12. The magnetic proximity switch system according to claim 11, wherein a combined width of the spacer block and the actuator assembly is at least the width of the actuation range.

13. The magnetic proximity switch system according to claim 11, wherein the spacer block is fixed to the actuator assembly.

14. The magnetic proximity switch system according to claim 11, wherein the magnetic proximity switch system monitors a security condition of an object, the first surface of the actuator assembly being mounted toward the object.

15. The magnetic proximity switch system according to claim 11, wherein the actuator assembly has a third surface that faces the switch assembly, each of the first and second surfaces being adjacent the third surface.

16. A magnetic proximity switch system, comprising:

a switch assembly having at least one magnetically actuated proximity switch which is actuated by a magnetic field; and an actuator assembly for providing the magnetic field to actuate the switch assembly when located in an actuation range defined about the switch assembly, at least one of the actuator assembly and the switch assembly being moveable relative to the other so that the actuator can be located within the actuation range of the switch assembly and outside of the actuation range of the switch assembly, the actuator assembly having a housing extended in a direction opposite to the direction of relative movement of the actuator assembly to prevent insertions into the actuation range as the at least one of the actuator assembly and the switch assembly is moved away from the other but the actuator assembly still in the actuation range of the switch assembly.

17. The magnetic proximity switch system according to claim 16, wherein a width of the actuator assembly is at least the width of the actuation range.

18. The magnetic proximity switch system according to claim 16, wherein the magnetic proximity switch system monitors a security condition of an object, the housing being extended in a direction away from the object.

19. The magnetic proximity switch system according to claim 16, wherein the housing has a first side that faces the switch assembly when the actuator assembly is in the actuation range and a second side that is adjacent the first side, the housing being extended in a direction of the second side.

* * * * *